US006023808A

United States Patent [19]

Chui

[11] Patent Number: 6,023,808

[45] Date of Patent: Feb. 15, 2000

[54] CONVENIENT BUTTON-LOCKING MOP HOLDER

[76] Inventor: Pui-Wang Chui, Room 1334, Sin Sam House, Luang Hang Estate, Shatin, N.T., The Hong Kong Special Administrative Region of the People's Republic of China

[21] Appl. No.: 09/165,568

[22] Filed: Oct. 2, 1998

[30] Foreign Application Priority Data

Jul. 29, 1998 [HK] The Hong Kong Special Administrative Region of the People's Republic of China ..... 98109525

[51] Int. Cl.[7] ..... A47L 13/24; A47L 13/252

[52] U.S. Cl. ..... 15/152; 15/151

[58] Field of Search ..... 15/147.1, 151, 15/152, 228, 229.1, 229.2

[56] References Cited

U.S. PATENT DOCUMENTS

| | | | |
|---|---|---|---|
| 1,037,703 | 9/1912 | Wolter | 15/152 |
| 1,619,624 | 3/1927 | Maszcyk | 15/151 |
| 2,486,757 | 11/1949 | Parker | 15/152 |
| 4,483,035 | 11/1984 | Moss et al. . | |

FOREIGN PATENT DOCUMENTS

| | | |
|---|---|---|
| 85200555 U | 1/1986 | China . |
| 85201458 U | 1/1986 | China . |
| Y-2146955 | 11/1993 | China . |
| Y-2260565 | 8/1997 | China . |

*Primary Examiner*—Terrence R. Till
*Attorney, Agent, or Firm*—Alix, Yale & Ristas, LLP

[57] ABSTRACT

A convenient button-locking mop holder is essentially comprised of a cloth bits frame, a locking bar and a locking device, said locking bar can more parallelly relative to the transverse bar of the cloth bits frame. When in use, first release the locking device to put the cloth bits between the transverse bar and the locking bar, and then push the locking bar toward the transverse bar to grip the cloth bits before fixing the locking bar with the locking device. The mop holder of the invention is of simple structure and convenient to use, and it is easy to replace the cloth bits of the mop.

6 Claims, 4 Drawing Sheets

CONVENIENT BUTTON-LOCKING MOP HOLDER

FIELD OF THE INVENTION

The present invention relates generally to a cleaning utensil for cleaning a floor in daily life, particularly to a convenient button-locking mop holder.

BACKGROUND OF THE INVENTION

A mop (swab) is a widely used cleaning utensil in people's daily life. There exist many hinds of mop holders which can generally be divided into ones with cloth bits being replaceable and the others with cloth bits being fixed, the former being more wildly used and being of many structures. For example, Chinese Patent No. 95243449 discloses a "mop holder" which is comprised of a circular ring, a connecting rib, a central rod, an annular hoop, etc. But, like existing mob holders, it still has the defects of being inconvenient to use, especially when replacing the mop cloth bits, and having a complicated structure.

SUMMARY OF THE INVENTION

The object of the invention is to provide a convenient button-locking mop holder to overcome the shortcomings in prior art. Due to the simple structure of its dual bar button-locking cloth bits holder and its locking device, while better keeping the operational functions and advantages of the prior art, it has the advantages of having a simple structure, being convenient to use, being easy to replace mop cloth bits and having a low cost.

The object of the present invention is achieved as such that the mop holder is essentially comprised of a cloth bits frame, a locking bar and a locking system. The cloth bits frame comprises a transverse bar, side bars and a connecting head connectable to a handle; the locking bar is capable of moving relatively along the side bars to adjust the distance between the locking bar and the transverse bar. When replacing the cloth bits, the distance between the locking bar and the transverse bar is adjusted to be larger; after putting in the cloth bits, the distance between the locking bar and the transverse bar is adjusted again to be smaller to grip the replaced cloth bits. The locking system comprises a central rod fixedly connected to the connecting head and extending inward therefrom, a sliding rod perpendicular to the locking bar and fixedly connected thereto in a T-form and a locking means.

With the simple dual bar button-locking cloth bits holder and the simple locking device, while better keeping the operational functions and advantages of the prior art, the convenient button-locking mop holder of the present invention has the advantages of having a simple structure, being convenient to use, being easy to replace the cloth bits and having a low cost. The mop holder of the invention overcomes the defects in prior art, and is a very convenient and practical cleaning utensil.

BRIEF DESCRIPTION OF THE DRAWINGS

An embodiment of the present invention will be described in detail in connection with the attached drawings, in which.

DETAILED DESCRIPTION OF THE PREFERRED EMBODIMENT

Figure 1:
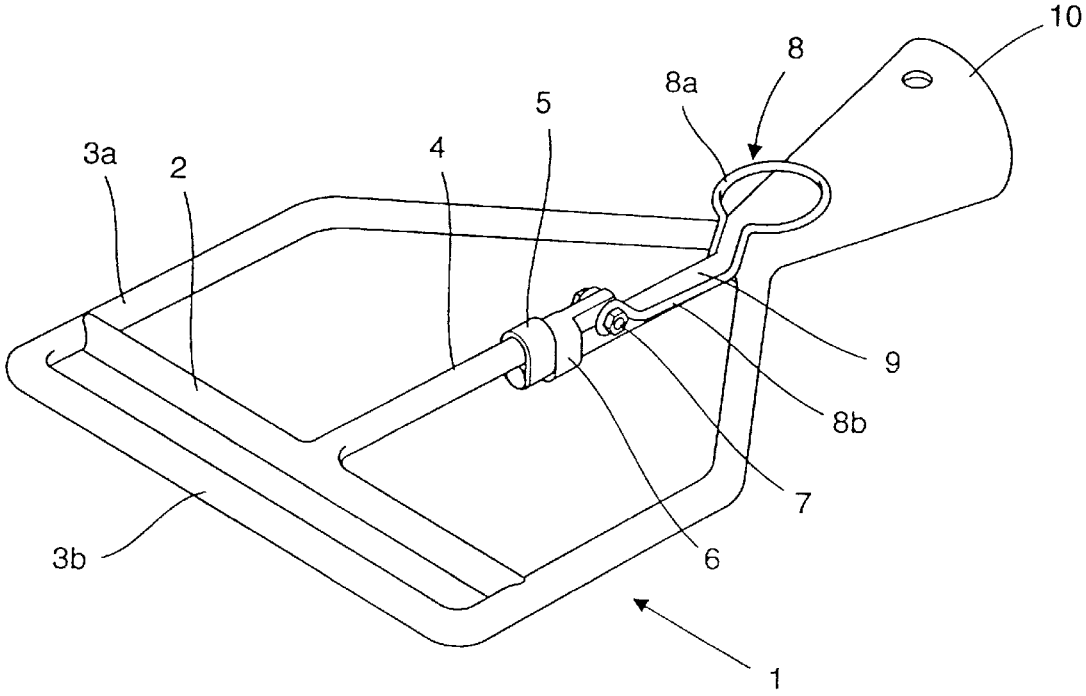
FIG. 1 is a structural schematic view of an embodiment of a mop holder in accordance with of the invention.

As shown in FIG. 1, the mop holder in accordance with the invention is essentially comprised of a cloth bits frame 1 and a locking bar 2. The cloth bits frame 1 comprises a transverse bar 3*b*, side bars 3*a* and a connecting head 10 connectable to a handle. The locking bar 2 is parallel to the transverse bar 3*b* and capable of moving relatively along side bars 3*a* so as to adjust the distance between the locking bar 2 and the transverse bar 3*b*. When it is necessary to replace the cloth bits, the distance between the locking bar 2 and the transverse bar 3*b* is adjusted to be larger; when replacement completed, the distance between the locking bar 2 and the transverse bar 3*b* will again be adjusted to be smaller to grip the replaced cloth bits.

Figure 2:
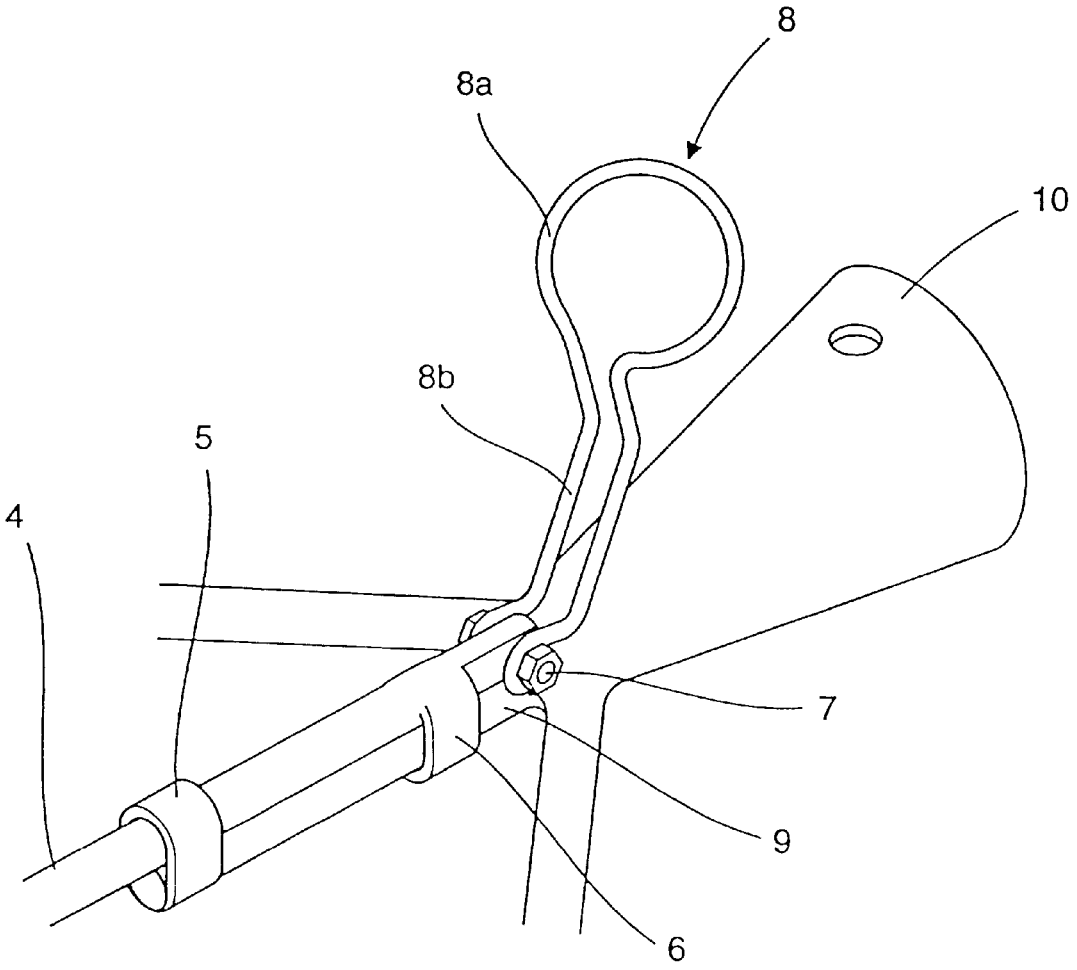
FIG. 2 is a side view of an embodiment of a locking system in accordance the invention.

In order for the locking bar 2 to be able to fixedly grip the cloth bits, a locking system is needed to lock the locking bar 2 at the right position. Referring to FIG. 2, one embodiment of the locking system in accordance with the invention includes a central rod 9 extending inward from the connecting head 10, and a sliding rod 4 perpendicular to the locking bar 2 and connected thereto in a T-form, wherein on the central rod 9 there is a fixed guide sleeve 5 into which the sliding rod 4 is inserted, the guide sleeve 5 is used to guide the sliding of the rod 4 and position the rod 4; and on the sliding rod 4 there can also be mounted a sliding sleeve 6 into which the central rod 9 is inserted, the sliding sleeve is used to assist the central rod 9 in sliding relative to the sliding rod 4 and position the central rod. Mounted at the end of the sliding rod 4 is a button-locking means 8, which functions to fix the sliding rod 4 relative to the central rod 9 when the cloth bits are gripped tightly between the locking bar 2 and the transverse bar 3*b* so that the locking bar 2 can not move. The buttom-locking means 8 can be of various structures, one solution is that the button-locking means 8 is in the form of dual bar comprising a rein 8*a* and a long button with two sides 8*b* (refer to FIG. 2), wherein the long button 8*b* can exactly grip the central rod 9 from two sides thereof with its two sides. The button-locking means 8 is ratably mounted at the end of the sliding rod 4 via a locking pin 7. The locking pin 7 can be of bolt type.

Figure 3:
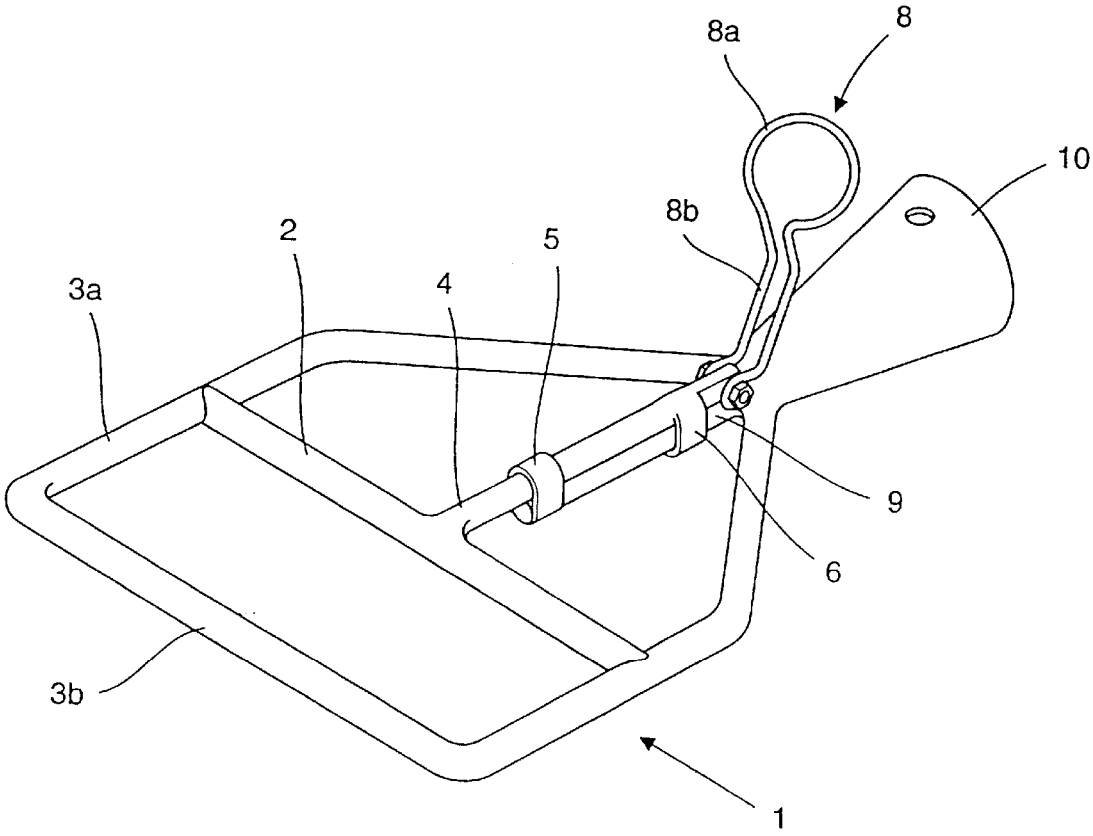
FIG. 3 is a view showing that a locking means is released when the mop holder of the present invention is in use.
Figure 4:
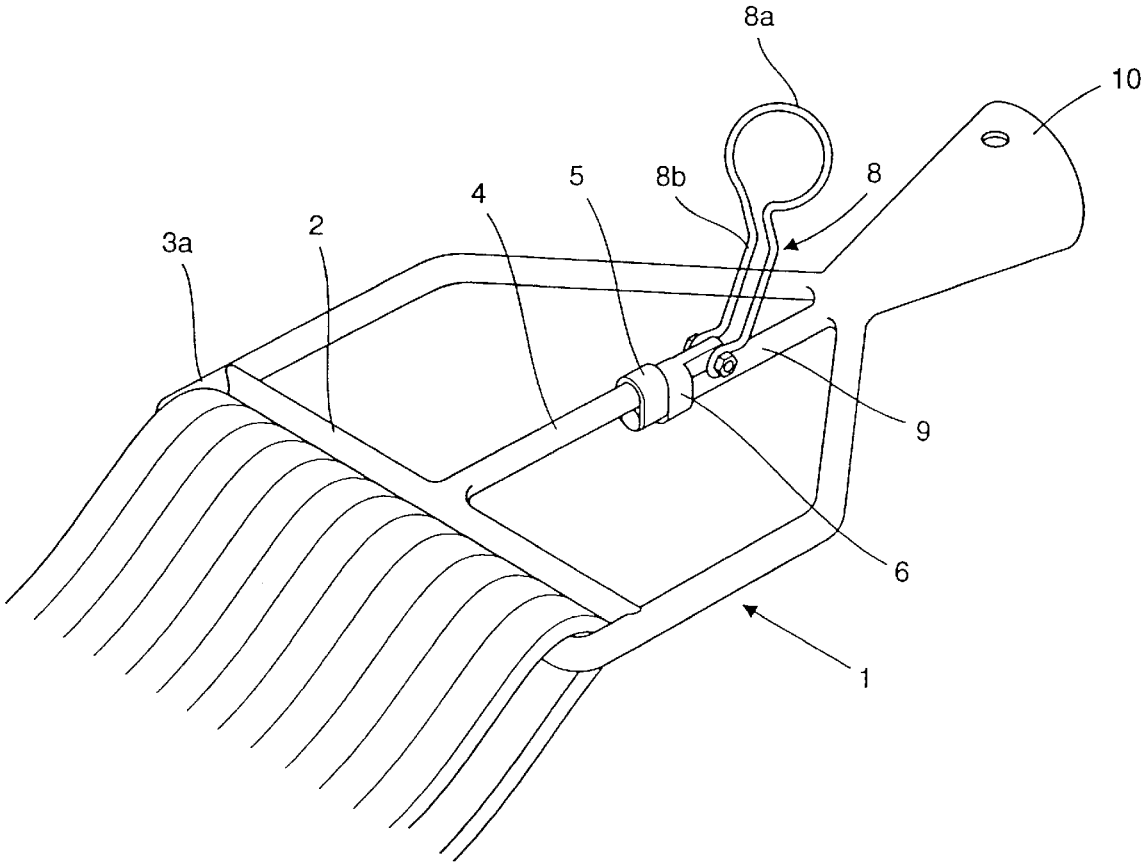
FIG. 4 is a perspective view showing that the locking means is to be pushed back to its locking position when the mop holder of the invention is in use.

Next, refer to FIGS. 3 and 4, when in use, lift the rein 8*a* with fingers first to separate the button-locking means 8 from the central rod 9; then push the sliding rod 4 toward the connecting head 10 so as to move the locking bar 2 away from the transverse bar 3*a* by a certain distance (as shown in FIG. 3); put the cloth bits between the locking bat 2 and the transverse bar 3*a* and put them in order; then move the locking bar 2 toward the transverse bar 3*a* to grip the cloth bits therebetween (as shown in FIG. 4); and finally push down the rein 8*a* with fingers to press the button-locking means 8 onto the central rod 9, causing the two sides of the long button 8*b* to exactly grip the central rod 9 form two sides thereof. Thus, the position of the sliding rod 4 relative to the central rod 9 is fixed, the locking bar 2 can not move any more. Then, the mop holder returns again to the state shown in FIG. 1.

It is possible for the present invention to adopt different types of locking systems based on the above described concept.

What is claimed is:

1. A convenient button-locking mop holder, comprising a cloth bits frame, a locking bar and a locking system, wherein said cloth bits frame comprises a transverse bar, a side bar and a connecting head which is connectable to a handle; said locking bar being disposed parallel to said transverse bar and slidably mounted on said side bar; and said locking system comprising a central rod connected to said connecting head and extending inward therefrom, a sliding rod perpendicular to said locking bar and connected thereto in a T-form, and a locking device.

2. The button-locking mop holder of claim 1, wherein on the central rod there is a fixed guide sleeve into which said sliding rod is inserted, said guide sleeve being used to assist the sliding rod in sliding and to position the sliding rod.

3. The button-locking mop holder of claim 1, wherein on said sliding rod there is mounted a sliding sleeve into which the central bar is inserted, said sliding sleeve being used to assist the central rod in sliding relative to the sliding rod and to position the central rod.

4. The button-locking mop holder of claim 1, wherein said locking device is a button-locking means rotatably mounted substantially at the end of the sliding rod, said button-locking means comprising a rein and a long button with two sides, wherein said long button grips said central rod from two sides thereof with its two sides.

5. The button-locking mop holder of claim 4, wherein said locking device further comprises a locking pin by which the button-locking means is rotatably mounted to the sliding rod.

6. The button-locking mop holder of claim 5, wherein said locking pin is of a bolt type.

* * * * *